US010260132B2

(12) United States Patent
Ryu et al.

(10) Patent No.: US 10,260,132 B2
(45) **Date of Patent: *Apr. 16, 2019**

(54) MAGNETIC BODY AND ELECTRONIC COMPONENT COMPRISING THE SAME

(71) Applicant: TAIYO YUDEN CO., LTD., Taito-ku, Tokyo (JP)

(72) Inventors: Minoru Ryu, Takasaki (JP); Shinsuke Takeoka, Takasaki (JP); Yoko Orimo, Takasaki (JP); Yoshiki Iwazaki, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 206 days.

This patent is subject to a terminal disclaimer.

(21) Appl. No.: 15/087,651

(22) Filed: Mar. 31, 2016

(65) Prior Publication Data

US 2016/0293308 A1 Oct. 6, 2016

(30) Foreign Application Priority Data

Mar. 31, 2015 (JP) ..... 2015-073692

(51) Int. Cl.
*H01F 1/33* (2006.01)
*H01F 1/24* (2006.01)
(Continued)

(52) U.S. Cl.
CPC ..... *C22C 38/02* (2013.01); *B22F 1/02* (2013.01); *C22C 38/06* (2013.01); *C22C 38/14* (2013.01);
(Continued)

(58) Field of Classification Search
CPC ..... H01F 1/33; H01F 1/24; H01F 1/14766; H01F 1/14783; H01F 1/14791;
(Continued)

(56) References Cited

U.S. PATENT DOCUMENTS 8,416,051 B2 * 4/2013 Matsuura ..... H01F 1/14783 252/62.51 C
8,704,629 B2 * 4/2014 Ogawa ..... H01F 41/098 336/233
(Continued)

FOREIGN PATENT DOCUMENTS

JP 5626672 B 11/2014
WO 2014112483 A1 7/2014

*Primary Examiner* — Matthew E. Hoban
*Assistant Examiner* — Lynne Edmondson
(74) *Attorney, Agent, or Firm* — Law Office of Katsuhiro Arai

(57) ABSTRACT

In an embodiment, a magnetic body includes soft magnetic alloy grains 11 containing Fe, element L, and element M (where element L is Si or Zr and element M is a metal element other than Si or Zr that oxidizes more easily than Fe), as well as oxide film produced from oxidization of part of these grains 11; wherein at least some of the bonds between adjacent soft magnetic alloy grains 11 are by way of the oxide film; the oxide film has an inner film 12*a*, and an outer film 12*b* positioned on the outer side of the inner film 12*a*; and the inner film 12*a* contains more of element L than element M, while the outer film 12*b* contains more of element M than element L.

7 Claims, 1 Drawing Sheet

(51) Int. Cl.

| | |
|---|---|
| ***H01F 1/147*** | (2006.01) |
| ***C22C 38/34*** | (2006.01) |
| ***C22C 38/28*** | (2006.01) |
| ***C22C 38/02*** | (2006.01) |
| ***C22C 38/14*** | (2006.01) |
| ***C22C 38/06*** | (2006.01) |
| ***B22F 1/02*** | (2006.01) |

(52) U.S. Cl.
CPC ..... *C22C 38/28* (2013.01); *C22C 38/34* (2013.01); *H01F 1/24* (2013.01); *H01F 1/33* (2013.01); *C22C 2202/02* (2013.01)

(58) Field of Classification Search
CPC ... H01F 1/12; H01F 27/24; H01F 5/00; C22C 38/34; C22C 38/06; C22C 38/18; C22C 38/0285; C22C 38/14; C22C 38/28; C22C 33/02; C22C 1/0458
USPC ..... 252/62.55, 62.51 R, 62.51 C, 62.58; 420/34, 78; 148/284
See application file for complete search history.

(56) References Cited

U.S. PATENT DOCUMENTS

| | | | | |
|---|---|---|---|---|
| 8,723,634 | B2 * | 5/2014 | Ogawa | H01F 1/33 29/602.1 |
| 8,749,339 | B2 * | 6/2014 | Ogawa | H01F 41/098 336/233 |
| 8,896,405 | B2 * | 11/2014 | Hachiya | H01F 1/40 336/200 |
| 9,007,159 | B2 * | 4/2015 | Hachiya | H01F 5/003 336/200 |
| 9,030,285 | B2 * | 5/2015 | Matsuura | H01F 1/14783 336/200 |
| 2011/0267167 | A1 * | 11/2011 | Ogawa | H01F 41/098 336/221 |
| 2013/0154784 | A1 * | 6/2013 | Hachiya | H01F 5/003 336/200 |
| 2015/0332850 | A1 | 11/2015 | Nishio et al. | |

* cited by examiner

MAGNETIC BODY AND ELECTRONIC COMPONENT COMPRISING THE SAME

BACKGROUND

Field of the Invention

The present invention relates to a magnetic body that can be used primarily as a magnetic core for coils, inductors and other electronic components, as well as an electronic component containing such magnetic body.

Description of the Related Art

Electronic components such as inductors, choke coils, transformers, etc. (so-called "coil components" and "inductance components") have a magnetic body as their magnetic core, and a coil formed inside or on the surface of the magnetic core. For the material of magnetic body, Ni—Cu—Zn ferrite and other types of ferrite are generally used.

There has been a demand for electronic components of this type to accommodate greater current (have higher current ratings) in recent years, and to meet this demand, switching the material of the magnetic body from the traditional ferrite materials to metal materials is being studied. Metal materials include Fe—Cr—Si alloy and Fe—Al—Si alloy whose saturated magnetic flux densities are higher than those of ferrite materials. On the other hand, these materials have substantially lower volume resistivities compared to ferrite materials.

Patent Literature 1 discloses a compacted powder magnetic core that uses Fe—Cr—Al alloy powder as soft magnetic material powder, and a method for manufacturing such powder magnetic core.

BACKGROUND ART LITERATURES

[Patent Literature 1] Japanese Patent No. 5626672

SUMMARY

Given the demand for smaller electronic components of higher performance of late, it is desired that high insulation resistance is maintained even when the Fe ratio is increased to ensure saturation characteristics. One object of the present invention is to provide a magnetic body that makes this possible. Furthermore, another object of the present invention is to provide an electronic component containing such magnetic body.

Any discussion of problems and solutions involved in the related art has been included in this disclosure solely for the purposes of providing a context for the present invention, and should not be taken as an admission that any or all of the discussion were known at the time the invention was made.

After studying in earnest by the inventors of the present invention, the present invention described below was completed.

According to the present invention, a magnetic body is provided which comprises soft magnetic alloy grains containing Fe, element L, and element M (where element L is Si or Zr and element M is a metal element other than Si or Zr that oxidizes more easily than Fe), as well as oxide film produced from oxidization of part of the soft magnetic alloy grains; wherein at least some of the bonds between adjacent soft magnetic alloy grains are by way of the oxide film; the oxide film has an inner film, and an outer film positioned on the outer side of the inner film; and the inner film contains more of element L than element M, while the outer film contains more of element M than element L.

An electronic component having a magnetic core that contains such magnetic body is also an embodiment of the present invention.

According to the present invention, high insulation property can be achieved because there are two types of oxide films including the inner film and outer film. When the ratio of Fe contained in these two types of oxide films is relatively low, the thickness of the oxide film can be reduced and the packing density is expected to increase. If the aforementioned element M is Cr or Al, the inductance characteristics and resistance change less in the moisture resistance test. Using such magnetic body, a smaller electronic component not affected by the environment can be produced.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
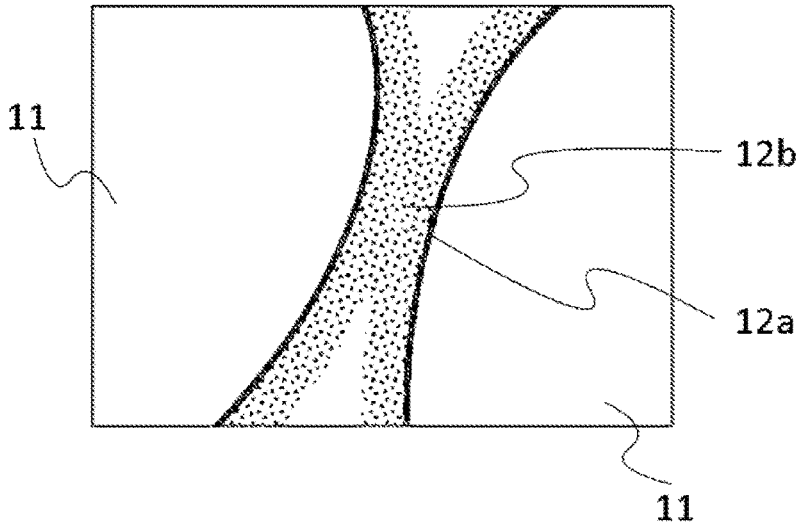
FIG. 1 is a schematic cross sectional view showing a micro-structure of the oxide film constituting the magnetic body proposed by the present invention.

11: Soft magnetic alloy grain
12*a*: Inner film
12*b*: Outer film

DETAILED DESCRIPTION OF EMBODIMENTS

The present invention is described in detail by referring to the drawings as deemed appropriate. It should be noted, however, that the present invention is not limited to the illustrated mode in any way, and that, because the characteristic parts of the invention may be emphasized in the drawings, accuracy of scale is not necessarily assured in each part of the drawings.

FIG. 1 is a schematic cross sectional view showing a micro-structure of the oxide film constituting the magnetic body proposed by the present invention. Under the present invention, the magnetic body as a whole is understood as an assembly of many initially independent soft magnetic alloy grains 11 that are bonded together. The magnetic body can also be described as a powder compact constituted by many soft magnetic alloy grains 11. In FIG. 1, an area near the interface of two soft magnetic alloy grains 11 is enlarged. Oxide film 12*a*, 12*b* is formed at least partially around, or preferably almost all around, the circumferences of at least some soft magnetic alloy grains 11, and this oxide film 12*a*, 12*b* ensures insulation property of the magnetic body. Adjacent soft magnetic alloy grains 11 are primarily bonded together via the oxide film 12*a*, 12*b* formed around each of these soft magnetic alloy grains 11, and a magnetic body having a specific shape is constituted as a result. According to the present invention, adjacent soft magnetic alloy grains 11 may be partially bonded together through their metal parts. Conventional magnetic bodies use a matrix of cured organic resin in which magnetic grains or coupled magnetic grains each consisting of several or so magnetic grains are distributed, or a matrix of cured glass component in which magnetic grains or coupled magnetic grains each consisting of several or so magnetic grains are distributed. Under the present invention, preferably virtually or substantially no organic resin matrix nor glass component matrix exists.

Individual soft magnetic alloy grains 11 are an alloy containing at least iron (Fe) and two types of elements that oxidize more easily than iron (referred to as "L" and "M" under the present invention). Element L and element M are different, each being a metal element or Si. If element M is a metal element, it is typically Cr (chromium), Al (aluminum), Ti (titanium), etc., and preferably Cr or Al. Preferably the magnetic body proposed by the present invention contains Si or Zr (zirconium) as element L. How two different metal elements or a metal element and Si are matched for element M and element L will be described later. In some embodiments, element L can be constituted by more than one element, and also element M can be constituted by more than one element.

The content of Fe in the magnetic body as a whole is preferably 92.5 to 96 percent by weight. When the Fe content is within this range, high volume resistivity is ensured. The content of element L in the magnetic body as a whole is preferably 1.5 to 3 percent by weight. The content of element M in the magnetic body as a whole is preferably 2 to 4.5 percent by weight. The composition of the magnetic body as a whole can be calculated by plasma emission analysis.

Elements that may be contained in the magnetic body, other than Fe and elements L and M, include Mn (manganese), Co (cobalt), Ni (nickel), Cu (copper), P (phosphorus), C (carbon), and the like, the content of which is typically less than that of element L and that of element M.

At least some of the individual soft magnetic alloy grains 11 constituting the magnetic body have oxide film 12*a*, 12*b* formed at least partially around their circumference. The oxide film 12*a*, 12*b* may be formed before the magnetic body is compacted, or specifically in the stage where it is still in a state of material grains, or the oxide film may be produced in the compacting process by keeping the oxide film non-existent or at a minimum in the material grains stage. When the soft magnetic alloy grains 11 before compacting are heat-treated to obtain the magnetic body, preferably the surface of the soft magnetic alloy grains 11 is oxidized to produce oxide film 12*a*, 12*b*, and multiple soft magnetic alloy grains 11 become bonded together via the oxide film 12*a*, 12*b* thus produced. Presence of oxide film 12*a*, 12*b* can be recognized as a contrast (brightness) difference on an image taken by a scanning transmission electron microscope (STEM) at magnifications of 100000 times or so. Also, presence of oxide film 12*b* can also be recognized as a contrast (brightness) difference on an image taken by a scanning electron microscope (SEM) at magnifications of 10000 times or so. Presence of oxide film 12*a*, 12*b* assures insulation property of the magnetic body as a whole.

As illustrated, the oxide film has at least two layers, of which the layer closer to the soft magnetic alloy grain 11 (or on the inner side to be specific) is called the inner film 12*a*. The oxide film positioned on the outer side of the inner film 12*a* is called the outer film 12*b*. Under the present invention, the inner film 12*a* contains more of element L than element M. In contrast, the outer film 12*b* contains more of element M than element L. Here, element L is Si or Zr, while element M is a metal element other than Si or Zr that oxidizes more easily than Fe.

Having the aforementioned inner film 12*a* and outer film 12*b*, the obtained magnetic body offers high insulation property as well as high mechanical strength.

Because element L is Si or Zr, the inner film 12*a* containing element L at a high ratio can be made thinner, to increase the packing ratio. Also, the additional presence of the outer film 12*b* makes inductance characteristics and resistance more stable in the moisture resistance test.

If the inner film 12*a* is too thin, the film loses its continuity and becomes unable to cover the surface of the soft magnetic alloy grain 11, resulting in lower insulation property; if the inner film 12*a* is too thick, magnetic permeability drops. If the outer film 12*b* is too thin, on the other hand, mechanical strength falls; if the outer film 12*b* is too thick, magnetic permeability drops. Preferably the thickness of the outer film 12*b* is greater than the thickness of the inner film 12*a*, as it satisfies both required mechanical strength and insulation property. In some embodiments, an average thickness of the inner film covering the soft magnetic alloy grains is in a range of 5 nm to 50 nm, and an average thickness of the outer film covering the inner film is in a range of 100 nm to 150 nm.

Methods to obtain oxide film 12*a*, 12*b* include keeping the presence of Fe oxide as low as possible in the material grain for magnetic body or keeping the material grain free of Fe oxide as much as possible (e.g., substantially free of Fe oxide except for Fe oxide formed by natural oxidation or so), and then oxidizing the alloy surface by means of heat treatment, etc., in the process of obtaining the magnetic body (wherein substantially the same elements constitute the soft magnetic alloy grains and the oxide film). Such treatment selectively oxidizes metal element M that oxidizes more easily than Fe, or Si, and consequently the weight ratios of element L and element M to Fe in the oxide film 12*a*, 12*b* tend to become relatively higher than the weight ratios of element L and element M to Fe in the soft magnetic alloy grain 11.

In the magnetic body, the soft magnetic alloy grains 11 are bonded together primarily via their oxide film 12*a*, 12*b*. Presence of bonds 22 via oxide film 12*a*, 12*b* can be visually recognized using, for example, a SEM-observed image magnified to approx. 5000 times. Presence of bonds via oxide film 12*a*, 12*b* (oxide-to-oxide bonding) improves the mechanical strength and insulation property. Preferably the adjacent soft magnetic alloy grains 11 are bonded together via their oxide film 12*a* 12*b* throughout the magnetic body, but sufficient improvement in mechanical strength and insulation property is achieved so long as they are bonded this way at least partially, and such mode is also an embodiment of the present invention. In addition, the soft magnetic alloy grains 11 may be bonded together directly (metal-to-metal bonding, metallic bonding), not via oxide film 12*a*, 12*b*, partially. Furthermore, a mode where the adjacent soft magnetic alloy grains 11 are simply contacting or close to each other physically, where there are no bonds via oxide film 12*a*, 12*b* or direct bonds of soft magnetic alloy grains 11, may be present partially. Moreover, the magnetic body may have voids in some parts.

Furthermore, the thickness of the oxide film 12*a*, 12*b* can be evaluated according to the method described below.

Method to Analyze Oxide Film (1) Prepare cross sectional samples for scanning electron microscope (SEM) cut through the center of the core.

(2) Randomly extract and select grain interfaces separated by oxide film using a SEM. Whether or not this is an interface between soft magnetic alloy grains 11 is determined according to the procedure described below. First, an image of the sample is obtained, and coordinates are set on the sample image to create a grid of 100 μm×100 μm. On the coordinates, only the core parts are selected and each coordinate is numbered, after which a random number is generated using a computer to select one point on the coordinates. The selected 100 μm×100 μm square is divided into a grid of 1 μm×1 μm. A random number is generated by a computer to select one point in this coordinate grid. Whether or not there is an interface between soft magnetic alloy grains 11 in the square is checked, and if there is no interface between soft magnetic alloy grains 11, a random number is generated again to select a different square, and this is repeated until an interface between soft magnetic alloy grains 11 is included in the selected square. An interface between soft magnetic alloy grains 11 in the selected square is selected.

(3) A thin sample is prepared with a focused ion beam (FIB) apparatus, cutting through the centers of the selected soft magnetic alloy grains 11 vertically to their interface. The micro-sampling method may be used to prepare a thin sample. The sample is adjusted to a thickness of 50 to 100 nm in the metal part of the soft magnetic alloy grain 11. The thickness of the sample is evaluated using an electron energy loss spectrometer equipped with a scanning transmission electron microscope (STEM: JEM-2100F manufactured by JOEL, Ltd.), according to a method that utilizes the inelastic scattering mean free path of transmitting electrons. By setting the half convergence angle to 9 mrad and take-off angle to 10 mrad for EELS measurement, the resulting inelastic scattering mean free path of 105 nm is used.

(4) Immediately after the sample has been prepared, a STEM equipped with an annular dark field detector and energy dispersive X-ray spectrometer (EDS) is used to check whether there is oxide film or not according to the STEM-EDS method, and if there is, the thickness of the oxide film is measured according to the STEM-high-angle annular dark field (HAADF) method. The specifics are as follows. The STEM-EDS measurement conditions are set to 200 kV of acceleration voltage, 1.0 nm of electron beam diameter, 1 nm/pix of resolution, and measurement time that gives a total signal intensity of 25 count or more in a range of 6.22 keV to 6.58 keV at each point on the Fe grain. An area where the signal intensity ratio of FeKα line+CrKα line and OKα line is 0.5 or higher is considered oxide film. The STEM-EDS method is not suitable for length measurement due to a wider signal generation area within the sample. Accordingly, the STEM-HAADF method described below is used for length measurement. The measurement conditions under the STEM-HAADF method are set to 0.7 nm or less of electron beam diameter, 27 mrad to 73 mrad of acceptance angle, 300000 times of magnifications, and 0.35 nm/pixel of pixel size. To eliminate the effects of noise, adjustments are made to make the signal intensity inside the image to $1.7\times10^6$ count or so. To align the magnifications for length measurement, a sample for magnification calibration is captured under the same conditions before and after the image is captured, to calibrate the scale. Before capturing each image, the magnifications are raised to the maximum value and then lowered to the original magnifications, after which the lens current is adjusted to a specified value (value used when the calibration sample was captured) and the sample height is adjusted. Also, the image is captured by scanning with an electron beam in the direction of traversing the interface.

(5) For the STEM-HAADF image, the signal intensity at each pixel in the image is approximated by a sum of linear functions of the vertical and horizontal coordinates of the image ($f(x)=ax+by$) and the result is subtracted from the image to lessen the background effect.

(6) In the STEM-HAADF image, a line segment of approx. 1 μm in length is drawn vertically in an area which is not a vacuum part and which is between metal grains sandwiching the oxide film 12*a* and oxide film 12*b* as determined from the STEM-EDS image, and a profile of image intensity is created according to this line segment. The line segment vertical to the oxide film 12*b* is obtained by extracting the position coordinates of the oxide film 12*b* from the signal intensity of oxygen element per STEM-EDS, drawing an approximation line according to the least squares method, and drawing a straight line vertical to this line.

(7) The intensity profile of the STEM-HAADF image is typically constituted by three types of intensities, corresponding to the soft magnetic alloy grain 11, oxide film 12*b*, and oxide film 12*a*, from the highest intensity. They become clear when compared against the EDX signal profile. To be more specific, the intensity I(x) in the profile is converted to the normalized intensity $I^{norm}(x)$ according to the equation below, and the range of this intensity can be used to make judgment.

Equation: $I^{norm}(x)=(I(x)-I^{min})/(I^{max}-I^{min})$; where, $I^{max}$ is the maximum value of intensity in the profile and $I^{min}$ is the minimum value of intensity in the profile. A corresponding range is $0.8<I^{norm}(x)\leq1.0$ for the soft magnetic alloy grain 11, $0.2<I_{norm}(x)\leq0.8$ for the oxide film 12*b*, and $0.0\leq I_{norm}(x)\leq0.2$ for the oxide film 12*a*.

(8) The method to obtain the thickness of the oxide film 12*a* and thickness of the oxide film 12*b* from the intensity profile of the STEM-HAADF image is described below. A position between the soft magnetic alloy grain 11 and oxide film 12*a* where the intensity becomes one half is defined as the interface between the soft magnetic alloy grain 11 and oxide film 12*a*. A position between the oxide film 12*b* and oxide film 12*a* where the intensity becomes one half is defined as the interface between the oxide film 12*b* and oxide film 12*a*. The distance from the interface between the soft magnetic alloy grain 11 and oxide film 12*a*, to the interface between the oxide film 12*b* and oxide film 12*a*, is obtained as the thickness of the oxide film 12*a*. Also, the thickness of the oxide film 12*b* is obtained as the distance from the interface between the oxide film 12*b* and oxide film 12*a*, to the outer edge of the oxide film 12*b*. Additionally, if a Fe oxide film is present on the outer side of the oxide film 12*b*, the corresponding thicknesses can be obtained by specifying the interface between them in the same manner.

(9) The grain interface is measured in the same manner for a total of 10 grains randomly selected from different 100 μm×100 μm squares, and the average thickness of the individual oxide films measured on all grains is given as the thickness of the oxide film in the sample.

Methods to produce bonds via oxide film 12*a*, 12*b* include, for example, applying heat treatment at the specified temperature described below in an ambience where oxygen is present (such as in air), when the magnetic body is manufactured.

Presence of the direct bonds between soft magnetic alloy grains 11 mentioned above can be visually recognized using, for example, a SEM-observed image (photograph of cross section) magnified to approx. 5000 times. Presence of direct bonds between soft magnetic alloy grains 11 improves magnetic permeability.

Methods to produce direct bonds between soft magnetic alloy grains 11 include, for example, using material grains having less oxide film, adjusting as described below the temperature and oxygen partial pressure of the heat treatment applied to manufacture the magnetic body, and adjusting the compacting density when the magnetic body is obtained from the material grains.

The composition of the magnetic grain used as the material (hereinafter also referred to as "material grain") will be reflected in the composition of the magnetic body to be finally obtained. Accordingly, a desired material grain composition can be selected as deemed appropriate according to the composition of the magnetic body to be finally obtained, and a favorable range for this composition is the same as the aforementioned favorable composition range for the magnetic body.

The sizes of individual material grains are virtually equal to the sizes of the grains constituting the magnetic body to be finally obtained. When the magnetic permeability and in-grain eddy current loss are considered, the material grain size is preferably 2 to 30 μm based on d50. The d50 of the material grain can be measured using a laser diffraction/scattering measurement apparatus.

Preferably the magnetic grain used as the material is manufactured according to the atomization method. Under the atomization method, the primary materials Fe, element L, and element M are added and melted in a high-frequency melting furnace. At this point, the weight ratios of primary components are checked. By applying the atomization method to the material thus obtained, magnetic grains can be obtained.

The method to obtain a compact from the material grains is not specifically limited in any way, and any known means for manufacturing a grain compact can be adopted as deemed appropriate. The following explains a typical manufacturing method whereby the material grains are compacted under non-heating conditions and then given heat treatment. It should be noted, however, that the present invention is not limited to this manufacturing method.

When the material grains are compacted under non-heating conditions, preferably organic resin is added as a binder. For the organic resin, preferably organic resin constituted by acrylic resin, butyral resin, vinyl resin, etc., whose thermal decomposition temperature is 500° C. or less is used in that not much binder will remain after the heat treatment. Any known lubricant may be added when compacting. The lubricant may be organic salts, etc., where specific examples include zinc stearate and calcium stearate. The amount of lubricant is preferably 0 to 1.5 parts by weight relative to 100 parts by weight of material grains. The amount of lubricant being zero means that no lubricant is used. Any binder and/or lubricant are/is added to the material grains and the mixture is agitated and then compacted to a desired shape. When compacting, 1 to 30 t/cm$^2$ of pressure is applied, for example.

A favorable mode of heat treatment is explained.

Preferably the heat treatment is performed in an oxidizing ambience. To be more specific, the oxygen concentration during heating is preferably 1% or more, as this makes it easier for bonds 22 via oxide film to generate. No specific upper limit of oxygen concentration is set, but one example is the oxygen concentration in air (approx. 21%) in consideration of the manufacturing cost, etc. The heating temperature is preferably 600 to 800° C. in that the soft magnetic alloy grains 11 themselves will oxidize to produce oxide film 12*a*, 12*b*, and bond easily via this oxide film 12*a*, 12*b*. The heating time is preferably 0.5 to 3 hours in that bonds 22 via oxide film 12*a*, 12 will generate easily.

The apparent density of the magnetic body obtained by heating is preferably 5.7 to 7.2 g/cm$^3$. The apparent density is measured according to a gas replacement method conforming to JIS R1620-1995. The apparent density can be adjusted primarily by the aforementioned compacting pressure. Both high magnetic permeability and high resistance are achieved so long as the apparent density is within the aforementioned range. It should be noted that voids 30 may exist in the magnetic body.

The magnetic body thus obtained can be used as a magnetic core for various electronic components. For example, an insulator-coated conductive wire can be wound around the magnetic body proposed by the present invention to form a coil. Or, green sheets containing the aforementioned magnetic grains can be formed according to a known method and specified patterns formed on them by printing or otherwise applying a conductive paste, after which the printed green sheets can be stacked and pressurized and the formed sheets heat-treated under the aforementioned conditions to obtain an electronic component (inductor) constituted by the magnetic body proposed by the present invention and a coil formed therein. Besides the above, the magnetic body proposed by the present invention can be used as a magnetic core by forming a coil inside or on the surface of it, to obtain various electronic components. Various mounting types of electronic components such as those of surface mounted type and of through hole mounted type are supported, and for the means for obtaining an electronic component from the magnetic body, the one described in "Examples" below may be referenced or any known manufacturing method used in the field of electronic components may be adopted as deemed appropriate.

EXAMPLES

The present invention is explained below in greater detail using examples. It should be noted, however, that the present invention is not limited in any way to the embodiments described in these examples.

Embodiment 1

Magnetic Grains

Soft magnetic alloy grains were prepared according to the atomization method. Under the atomization method, Fe, Cr, Si, Al, and Zr were used as materials. The compositions of soft magnetic alloy grains are shown in Table 1 (unit: percent by weight). These compositions are based on the total of Fe, Cr, Si, Al, and Zr equal to 100 percent by weight, with sulfur (S) added at specified percentages relative to these primary components representing 100 percent by weight. The compositions of soft magnetic alloy grains were checked using the combustion/infrared absorption method for sulfur (S) and using plasma emission analysis for the elements other than S. The average size of soft magnetic alloy grains was set to 10 μm.

(Manufacture of Magnetic Body)

100 parts by weight of these material grains were mixed under agitation with 1.5 parts by weight of PVA binder, to which 0.5 parts by weight of zinc stearate was added as lubricant. Thereafter, the mixture was compacted into the shape for each of the evaluations described later, at a compacting pressure of 6 to 12 tons/cm$^2$. Here, the compacting pressure was adjusted so that the soft magnetic alloy grains would be packed at a ratio of 85 percent by volume in the magnetic body. Next, heat treatment was applied for 1 hour in an atmospheric ambience (oxidizing ambience) at 750° C. in Example 11 or 700° C. in all other examples, to obtain a magnetic body.

TABLE 1

| | Fe [wt %] | Cr [wt %] | Al [wt %] | Si [wt %] | Zr [wt %] | S [wt %] |
|---|---|---|---|---|---|---|
| Comparative Example 1 | 92.5 | 4.5 | — | 3 | — | 0.001 |
| Comparative Example 2 | 96 | 2 | — | 2 | — | 0.001 |
| Comparative Example 3 | 92.5 | 4.5 | — | — | 3 | 0.001 |
| Comparative Example 4 | 96 | 2 | — | — | 2 | 0.001 |
| Example 1 | 92.5 | 4.5 | — | 3 | — | 0.003 |
| Example 2 | 94 | 4.5 | — | 1.5 | — | 0.003 |
| Example 3 | 96 | 2 | — | 2 | — | 0.003 |
| Example 4 | 94 | — | 4.5 | — | 1.5 | 0.003 |
| Example 5 | 94 | 4.5 | — | 1.5 | — | 0.005 |
| Example 6 | 94 | 4.5 | — | 1.5 | — | 0.014 |

TABLE 1-continued

| | Fe [wt %] | Cr [wt %] | Al [wt %] | Si [wt %] | Zr [wt %] | S [wt %] |
|---|---|---|---|---|---|---|
| Example 7 | 94 | 4.5 | — | 1.5 | — | 0.020 |
| Example 8 | 94 | 4.5 | — | 1.5 | — | 0.025 |
| Example 9 | 92.5 | 4.5 | — | — | 3 | 0.003 |
| Example 10 | 96 | 2 | — | — | 2 | 0.003 |
| Example 11 | 96 | 2 | — | 2 | — | 0.003 |

Embodiment 2

Magnetic Grains

Soft magnetic alloy grains were prepared according to the atomization method. Under the atomization method, Fe, Cr, and Si were used as materials. The compositions of soft magnetic alloy grains are shown in Table 2 (unit: percent by weight).

(Manufacture of Magnetic Body)

100 parts by weight of these material grains were mixed under agitation with a specified percentage of iron chloride (III) powder, together with 1.5 parts by weight of PVA binder, to which 0.5 parts by weight of zinc stearate was added as lubricant. The added amount of iron chloride (III) powder was adjusted so that, based on the total of Fe, Cr, Si, and Al equal to 100 percent by weight, chloride (Cl) would account for a specified percentage of these primary components representing 100 percent by weight. The added amounts of iron chloride (III) powder are shown in Table 2 under $FeCl_3$. Thereafter, the mixture was compacted into the shape for each of the evaluations described later, at a compacting pressure of 6 to 12 tons/cm$^2$. Here, the compacting pressure was adjusted so that the soft magnetic alloy grains would be packed at a ratio of 85 percent by volume in the magnetic body. Next, heat treatment was applied for 1 hour in an atmospheric ambience (oxidizing ambience) at 700° C., to obtain a magnetic body.

TABLE 2

| | Fe [wt %] | Cr [wt %] | Al [wt %] | Si [wt %] | Zr [wt %] | $FeCl_3$ [wt %] |
|---|---|---|---|---|---|---|
| Example 12 | 94 | 4.5 | — | 1.5 | — | 0.004 |
| Example 13 | 94 | 4.5 | — | 1.5 | — | 0.007 |
| Example 14 | 94 | 4.5 | — | 1.5 | — | 0.017 |
| Example 15 | 94 | 4.5 | — | 1.5 | — | 0.023 |
| Example 16 | 94 | 4.5 | — | 1.5 | — | 0.030 |

The relationships of the content of element L and that of element M in the inner film and outer film in each example are shown below. From the STEM-EDX element intensity map, the K line intensities of element M and element L in the inner film 12*a* and outer film 12*b* were extracted. Using these values, the quantitative measures of element L and element M in the inner film and outer film, respectively, were compared. The relationships by quantitative measures of the respective elements are shown in parentheses.

Comparative Example 1: Inner Film (Unidentifiable), Outer Film (Cr>Fe>Si)

Comparative Example 2: Inner Film (Unidentifiable), Outer Film (Cr>Fe>Si)

Comparative Example 3: Inner Film (Unidentifiable), Outer Film (Zr>Fe>Si)

Comparative Example 4: Inner Film (Unidentifiable), Outer Film (Zr>Fe>Si)

Example 1: Inner Film (Si>Fe>Cr), Outer Film (Cr>Fe>Si)

Example 2: Inner Film (Si>Fe>Cr), Outer Film (Cr>Fe>Si)

Example 3: Inner Film (Si>Fe>Cr), Outer Film (Cr>Fe>Si)

Example 4: Inner Film (Zr>Al>Fe), Outer Film (Al>Fe>Zr)

Example 5: Inner Film (Si>Fe>Cr), Outer Film (Cr>Fe>Si)

Example 6: Inner Film (Si>Fe>Cr), Outer Film (Cr>Fe>Si)

Example 7: Inner Film (Si>Fe>Cr), Outer Film (Cr>Fe>Si)

Example 8: Inner Film (Si>Fe>Cr), Outer Film (Cr>Fe>Si)

Example 9: Inner Film (Zr>Fe>Cr), Outer Film (Cr>Fe>Zr)

Example 10: Inner Film (Zr>Fe>Cr), Outer Film (Cr>Fe>Zr)

Example 11: Inner Film (Si>Fe>Cr), Outer Film (Cr>Fe>Si)

Example 12: Inner Film (Si>Fe>Cr), Outer Film (Cr>Fe>Si)

Example 13: Inner Film (Si>Fe>Cr), Outer Film (Cr>Fe>Si)

Example 14: Inner Film (Si>Fe>Cr), Outer Film (Cr>Fe>Si)

Example 15: Inner Film (Si>Fe>Cr), Outer Film (Cr>Fe>Si)

Example 16: Inner Film (Si>Fe>Cr), Outer Film (Cr>Fe>Si)

EVALUATIONS

The composition of each magnetic body was checked using the combustion/infrared absorption method for sulfur (S) and using plasma emission analysis for the elements other than S, and it was confirmed that the composition of the magnetic grain was reflected directly. Each magnetic body was observed using a TEM, and it was confirmed that the magnetic grains were bonded together via oxide film.

Volume resistivity was measured according to JIS-K6911. To be specific, a disk-shaped magnetic body of 9.5 mm in outer diameter and 4.2 to 4.5 mm in thickness was manufactured as a measuring sample. When the aforementioned heat treatment was applied, Au film was formed by sputtering on both of the bottom surfaces (entire bottom surfaces) of the disk. 25 V (60 V/cm) of voltage was applied to both sides of the Au film. The volume resistivity was calculated from the resistance measured.

A toroidal magnetic body of 14 mm in outer diameter, 8 mm in inner diameter and 3 mm in thickness was manufactured for measuring magnetic permeability A 0.3-mm diameter coil constituted by urethane-coated copper wire was wound around this magnetic body by 20 turns, to obtain a measuring sample. The magnetic permeability of the magnetic body was measured at a measuring frequency of 100 kHz using a L chrome meter (4285A manufactured by Agilent Technologies).

A disk-shaped magnetic body of 9.5 mm in outer diameter and 4.2 to 4.5 mm in thickness was manufactured as a measuring sample, for measuring withstand voltage. When the aforementioned heat treatment was applied, Au film was formed by sputtering on both of the bottom surfaces (entire bottom surfaces) of the disk. Voltage was applied to both sides of the Au film to perform I-V measurement. The applied voltage was gradually raised and when the current density reached 0.01 A/cm$^2$, the voltage applied then was considered the breakdown voltage. The sample was ranked C if the breakdown voltage was less than 25 V, B if the breakdown voltage was 25 V or more but less than 100 V, or A if the breakdown voltage was 100 V or more.

A magnetic body of 9.5 mm in outer diameter and 4.2 to 4.5 mm in thickness was manufactured for measuring anti-rust property. This magnetic body was left for 100 hours in a high-temperature, high-humidity condition of 85° C./85%. The magnetic body was measured for change in outer diameter dimension before and after the test, and ranked A if the change in dimension was less than 0.01 mm, B if the change in dimension was 0.01 mm or more but less than 0.03 mm, or C if the change in dimension was 0.03 mm or more.

Figure 2:
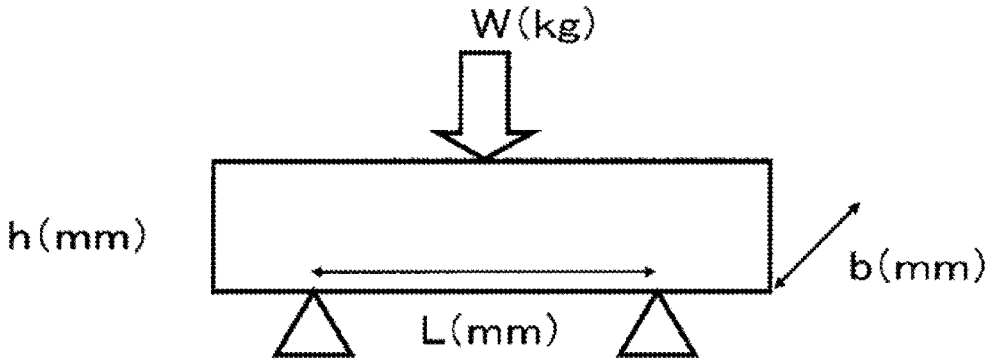
FIG. 2 is a schematic view explaining how 3-point bending rupture stress is measured.

3-point bending rupture stress was measured for evaluating mechanical strength. FIG. 2 is a schematic drawing explaining how 3-point bending rupture stress is measured. Load was applied to the measuring target as illustrated and the load W that caused the measuring target to rupture was measured. In consideration of bending moment M and geometrical moment of inertia I, 3-point bending rupture stress σb was calculated according to the equation below:

$$\sigma b=(M/I)\times(h/2)=3WL/2bh^2$$

For the test piece for measuring 3-point bending rupture stress, a sheet-shaped magnetic body of 50 mm in length, 10 mm in width, and 4 mm in thickness was manufactured as a measuring sample.

The evaluation results are shown in Table 3.

TABLE 3

| | Thickness of inner film [nm] | Thickness of outer film [nm] | Volume resistivity [Ω · cm] | Magnetic permeability μ | Withstand voltage [V] | Rust | Element body strength [kgf/cm2] |
|---|---|---|---|---|---|---|---|
| Comparative Example 1 | — | 340 | 2.0 × 10^2 | 40 | B | A | 10 |
| Comparative Example 2 | — | 277 | 3.7 × 10^−1 | 42 | C | B | 9.5 |
| Comparative Example 3 | — | 281 | 5.6 × 10^1 | 41 | B | A | 11 |
| Comparative Example 4 | — | 290 | 1.1 × 10^−1 | 42 | C | C | 10 |
| Example 1 | 5 | 128 | 3.3 × 10^5 | 49 | B | A | 10 |
| Example 2 | 5 | 122 | 1.7 × 10^5 | 51 | B | A | 9.5 |
| Example 3 | 5 | 100 | 1.2 × 10^5 | 52 | B | A | 9.5 |
| Example 4 | 6 | 138 | 3.7 × 10^5 | 50 | B | A | 16 |
| Example 5 | 10 | 131 | 9.4 × 10^5 | 50 | A | A | 16 |
| Example 6 | 50 | 129 | 3.3 × 10^5 | 49 | A | A | 15 |
| Example 7 | 82 | 115 | 3.7 × 10^5 | 45 | A | A | 14 |
| Example 8 | 101 | 109 | 4.2 × 10^5 | 43 | A | A | 13 |
| Example 9 | 5 | 123 | 2.6 × 10^5 | 50 | B | A | 10 |
| Example 10 | 5 | 98 | 1.0 × 10^5 | 53 | B | A | 9.5 |
| Example 11 | 6 | 100 | 1.9 × 10^5 | 51 | B | B | 16 |
| Example 12 | 6 | 125 | 1.2 × 10^5 | 50 | B | A | 10 |
| Example 13 | 9 | 134 | 7.3 × 10^5 | 50 | A | A | 10 |
| Example 14 | 52 | 135 | 2.1 × 10^6 | 48 | A | A | 16 |
| Example 15 | 81 | 121 | 3.2 × 10^6 | 45 | A | A | 16 |
| Example 16 | 103 | 115 | 3.5 × 10^6 | 43 | A | A | 15 |

These results show that the volume resistivities in the comparative examples were lower. This indicates that the inner film 12*a* did not completely cover the surface of the soft magnetic alloy grains 11, and the thickness was not measurable, either, in these examples. On the other hand, the volume resistivity increased when the inner film 12*a* was made 5 nm or thicker, in which case the film was confirmed over the entire circumference of the grain surface when a cross section of the soft magnetic alloy grain 11 was observed. In particular, making the inner film 12*a* 10 nm or thicker also boosted withstand voltage, which would open the door for wider applications. Similarly, the outer film 12*b* was also confirmed over the entire circumference on the outer side of the inner film 12*a*. Because the inner film 12*a* and outer film 12*b* cover the surface of the soft magnetic alloy grain 11, respectively, as described above, oxide film 12*a*, 12*b* offering not only insulation property, but also strong resistance to rust, is obtained. This eliminates any environmental effect such as high temperature and high humidity and prevents inductance characteristics and resistance from changing. It should be noted, however, that oxide film 12*a*, 12*b* does not exist in any area where the soft magnetic alloy grain 11 is directly bonded with other grain, and the aforementioned surface refers to the surface of the soft magnetic alloy grain 11 excluding these areas.

Also in Example 3, the relatively thin outer film 12*b* boosted magnetic permeability. However, the thinner the outer film 12*b*, the more easily the strength drops. On the other hand, in Example 11, the heat treatment temperature was adjusted, or specifically the temperature was set a little higher, to allow for formation of Fe oxide (not illustrated) on the outer side of the outer film 12*b*. This Fe oxide film can fill voids in the magnetic body without increasing the thickness of the inner film 12*a* or that of the outer film 12*b*. This way, high magnetic permeability can be maintained and the element body strength can be increased. In addition, presence of Fe oxide film allows for adjustment of temperature characteristics. Presence of Fe oxide film on the soft magnetic alloy grain 11 via the oxide film 12*a*, 12*b* reduces changes in temperature characteristics and makes it possible to achieve constant magnetic characteristics over a wider temperature range. As a result, a magnetic body whose characteristics do not change in a use environment of 150° C., for example, can be obtained.

Using such magnetic body 11, a highly reliable wound or laminated coil component can be produced. In particular, insulation property can be ensured even when the percentage of Fe is raised to a range of 92.5 to 96 percent by weight in Fe content, and even when the packing ratio is raised, and an inductor that is smaller and supporting higher current than heretofore possible can still be produced, which contributes to higher performance of electronic equipment.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2015-073692, filed Mar. 31, 2015, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A magnetic body comprising:

soft magnetic alloy grains containing Fe, element L, and element M where element L is Si or Zr and element M is a metal element other than Si or Zr that oxidizes more easily than Fe, as well as oxide film produced from oxidization of part of the soft magnetic alloy grains;

wherein adjacent soft magnetic alloy grains are bonded at least partly by the oxide film;

the oxide film is constituted by two identifiable films: an inner film, and an outer film located on an outer side of the inner film; and the inner film contains more of element L than element M, and the outer film contains more of element M than element L, wherein the soft magnetic alloy grains further contain sulfur (S), and the content of Fe in the magnetic body as a whole is 92.5 to 96 percent by weight, the content of element L in the magnetic body as a whole is 1.5 to 3 percent by weight, and the content of element M in the magnetic body as a whole is 2 to 4.5 percent by weight.

2. A magnetic body according to claim 1, wherein an average thickness of the inner film covering the soft magnetic alloy grains is in a range of 5 nm to 50 nm, and an average thickness of the outer film covering the inner film is in a range of 100 nm to 150 nm.

3. An electronic component having a magnetic core that contains a magnetic body according to claim 1.

4. An electronic component having a magnetic core that contains a magnetic body according to claim 2.

5. A magnetic body according to claim 1, wherein the soft magnetic alloy grains are substantially free of Fe oxide.

6. A magnetic body according to claim 1, wherein the inner film contains Fe, element L, and element M, where L>Fe>M, and the outer film contains Fe, element L, and element M, where M>Fe>L.

7. A magnetic body according to claim 1, wherein the content of sulfur (S) in the magnetic body as a whole is 0.003 percent or more by weight.

* * * * *